US006299293B1

(12) United States Patent
Imanaka et al.

(10) Patent No.: US 6,299,293 B1
(45) Date of Patent: Oct. 9, 2001

(54) SUBSTRATE FOR LIQUID DISCHARGE HEAD, LIQUID DISCHARGE HEAD AND LIQUID DISCHARGE APPARATUS

(75) Inventors: Yoshiyuki Imanaka, Kawasaki; Ichiro Saito, Yokohama; Toshio Kashino, Chigasaki; Teruo Ozaki, Yokohama; Masahiko Kubota, Tokyo; Muga Mochizuki, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/451,873

(22) Filed: Dec. 1, 1999

(30) Foreign Application Priority Data

Dec. 3, 1998 (JP) ..... 10-344730

(51) Int. Cl.[7] ..... B41J 2/05
(52) U.S. Cl. ..... 347/58; 347/65
(58) Field of Search ..... 347/63, 65, 56, 347/57–59, 67

(56) References Cited

U.S. PATENT DOCUMENTS 4,723,129 * 2/1988 Endo et al. ..... 347/56
5,278,585 1/1994 Karz et al. ..... 347/65
5,821,962 * 10/1998 Kudo et al. ..... 347/65
5,886,713 3/1999 Okada et al. ..... 347/14

FOREIGN PATENT DOCUMENTS 0 811 490 12/1997 (EP) ..... B41J/2/05
0 841 166 5/1998 (EP) ..... B41J/2/14

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A substrate, for use in a liquid discharge head for discharging liquid by applying thermal energy thereto, is provided with a heat generating member for applying the thermal energy to the liquid and a movable member so positioned as to be opposed to the heat generating member, to be fixed at the upstream side in the flowing direction of the liquid and to have a free end at the downstream end. Two wiring layers for applying a voltage to the heat generating member are provided in a superposed manner with an interlayer insulation layer therebetween and are mutually connected electrically via a through-hole. The through-hole is provided in a position different from the boundary between a fixing portion and a movable portion of the movable member.

11 Claims, 9 Drawing Sheets

SUBSTRATE FOR LIQUID DISCHARGE HEAD, LIQUID DISCHARGE HEAD AND LIQUID DISCHARGE APPARATUS

BACKGROUND OF THE INVENTION

Field of the Invention

The present invention relates to a liquid discharge head and a liquid discharge apparatus for discharging desired liquid by generation of a bubble induced by action of thermal energy on the liquid, and more particularly to the configuration of a substrate on which is formed a thermal energy generating element for generating thermal energy.

The present invention is applicable to an apparatus such as a printer for recording on various recording media such as paper, yarn, fiber, cloth, metal, plastics, glass, timber or ceramics, a copying apparatus, a facsimile apparatus provided with a communication system, or a word processor equipped with a printer unit, or to an industrial recording apparatus combined with various processing apparatuses.

In the present invention, the term "recording" means not only providing the recording medium with a meaningful image such as a character or graphics but also with a meaningless image such as a pattern.

There is already known the so-called bubble jet recording method, namely an ink jet recording method of providing ink with an energy such as heat to cause a state change involving an abrupt volume change in the ink, discharging ink from the discharge opening by an action force based on such state change and depositing the ink onto a recording medium to form an image. The recording apparatus employing such bubble jet recording method is generally provided, as disclosed in U.S. Pat. No. 4,723,129, with a discharge opening for discharging ink, an ink path communicating with the discharge opening and an electrothermal converting member provided in the ink path and serving as energy generating means for generating energy for discharging the ink.

Such recording method has various advantages, such as recording an image of high quality at a high speed with a low noise level, and recording an image of a high resolution or even a color image with a compact apparatus since, in the head executing such recording method, the ink discharge openings can be arranged at a high density. For this reason, the bubble jet recording method is recently employed in various office equipment such as printers, copying machines, facsimile machines, etc., and even in industrial systems such as fabric dyeing apparatuses.

With the spreading of the bubble jet technology into various fields, various demands are arising as explained in the following.

For example, in order to satisfy a demand for improving the energy efficiency, there is conceived optimization of the heat generating member, such as adjustment of the thickness of the protective film for the heat generating member. This method is effective in improving the efficiency of propagation of the generated heat to the liquid.

Also for obtaining an image of high quality, there is proposed a driving method for liquid discharge capable of realizing a faster ink discharging speed and satisfactory ink discharge based on stable bubble generation, and, for achieving high-speed recording, there is proposed an improved shape of the liquid path for realizing the liquid discharge head with a faster refilling speed of the liquid into the liquid path.

The present invention is to improve the fundamental discharge characteristics of the basically conventional method of discharging liquid by forming a bubble, particularly a bubble based on film boiling, in the liquid path, to a level that cannot be anticipated before.

The present inventors have made intensive investigations in order to provide a novel liquid droplet discharging method utilizing the conventionally unavailable bubble and a head utilizing such method. In these investigations, there have been executed a first technical analysis on the function of the movable member in the liquid path, analyzing the principle of the mechanism of the movable member in the liquid path, a second technical analysis on the principle of liquid droplet discharge by the bubble, and a third technical analysis on the bubble forming area of the heat generating member for bubble formation, and, through these analyses, there has been established a completely novel technology of positively controlling the bubble by positioning the fulcrum and the free end of the movable member in such a manner that the free end is provided at the side of the discharge opening or at the downstream side and by positioning the movable member so as to be opposed to the heat generating member or the bubble generating area.

Then, in consideration of the effect of the energy of the bubble itself on the discharge amount, there is obtained knowledge that the growing component in the downstream side of the bubble is the largest factor capable of drastically improving the discharge characteristics. More specifically, it has been found that the efficient conversion of the growing component in the downstream side of the bubble toward the discharging direction leads to an improvement in the discharge efficiency and discharge speed.

It has further been found that structural consideration is desirable on the movable member or the liquid path relating to the heat generating area serving to form the bubble, for example relating to the bubble growth in the downstream side with respect to the central line passing through the areal center of the electrothermal converting member in the liquid flowing direction, or in the downstream side of the bubble with respect to the areal center of the area contributing to the bubble generation.

It has further been found that the refilling speed can be significantly improved by giving consideration to the arrangement of the movable member and the structure of the liquid supply path.

SUMMARY OF THE INVENTION

The above-mentioned object can be attained, according to the present invention, by a substrate adapted for use in the liquid discharge head for discharging liquid by providing thermal energy thereto and provided with a heat generating member for providing the liquid with thermal energy and a movable member formed by a photolithographic process and so positioned as to be opposed to the heat generating member and having a fixed end at the upstream end in the liquid flowing direction and a free end at the downstream end, wherein:

- two wiring layers for applying a voltage to the heat generating member are mutually superposed with an interlayer insulation layer therebetween and are mutually connected electrically through a through hole; and
- the through hole is provided in a position different from the boundary between a fixed portion and a movable portion of the movable member.

Also according to the present invention, there is provided a substrate for use in the liquid discharge head for discharging liquid by giving thermal energy thereto, the substrate being surfacially provided with plural heat generating members for providing the thermal energy to the liquid and plural movable members so formed by photolithographic technology as to be opposed to the heat generating members and to be fixed at the upstream side in the flowing direction of the liquid and to have free movable ends at the downstream end, wherein:

two wiring layers for applying a voltage to the plural heat generating member are provided in a superposed manner with an interlayer insulation layer therebetween and are mutually connected electrically via plural through holes; and the plural through holes are provided in positions different from the boundary between fixing portions and movable portions of the movable members.

The substrate for the liquid discharge head is provided thereon with a heat generating member for providing the ink with thermal energy, and wirings for applying a voltage to the heat generating member, and has step differences on the surface. On the other hand, on the surface of the substrate for the liquid discharge head, a movable member is formed so as to be opposed to the heat generating member, and such movable member displaces by the pressure change of the bubble generated in the liquid by the heat generated by the heat generating member, thereby satisfactorily controlling the discharge pressure toward the downstream side of the liquid flowing direction. As this movable member is formed by a photolithographic process, the movable member bears a step difference if the surface of the substrate has a step difference in an area corresponding to the movable member. The movable member is displaced by the pressure change of the bubble as explained above, and the stress is concentrated on the step difference at such displacement. Such stress appears strongly particularly on the fulcrum of the movable member, thus affecting the durability thereof.

Therefore the present invention defines the position or height of the step difference formed on the surface of the substrate for the liquid discharge head, thereby relaxing the force applied to the movable member at the displacement thereof.

More specifically, in case two wiring layers for applying a voltage to the heat generating member are mutually superposed with an interlayer insulation layer therebetween and are electrically connected by a through hole, such through hole is provided in a position different from the boundary between the fixing portion and the movable portion of the movable member, whereby the step difference is not present in the vicinity of the fulcrum of the movable member. As a result, the stress concentration can be relaxed in a portion receiving the largest stress at the displacement of the movable member and the durability thereof can be improved. Also the through hole is positively positioned in the fixing portion of the movable member to improve the adhesion force of the fixing portion and also to improve the reliability of the movable member. Such configuration is further preferred because the fixing portions of the plural movable members can be formed in common (in a continuous form) to disperse the stress applied to the fixing portions covering the through hole.

Also in case the movable member is formed on the substrate by the photolithographic technology (and film forming technology), the shape and film quality of the movable member vary according to the step difference mentioned above. If the step difference is positioned at the boundary between the fixing portion and the movable portion of the movable member, the desired performance may not be achievable not only because of the aforementioned stress concentration but also because of the deterioration in the film quality of the movable member and instability of shape thereof, but the configuration of the present invention enables to stabilize the shape and film quality of the movable member, thereby allowing to provide the substrate for the liquid discharge head and the liquid discharge head, with high reliability.

The liquid discharge head of the present invention, provided with an element substrate surfacially bearing a heat generating member for providing the liquid with thermal energy, a ceiling plate member bearing a discharge opening for discharging ink and a groove communicating with the discharge opening and constituting a liquid path containing the heat generating member upon being adhered to the element substrate, and a movable member formed by a photolithographic technology so as to be opposed to the heat generating member in the liquid path and to have an end at the upstream side, in the liquid flowing direction, fixed to the element substrate and a free end at the end of the downstream side, is featured by a fact that the above-described substrate of the present invention for the liquid discharge head is employed as the element substrate mentioned above.

The liquid discharge apparatus of the present invention comprises the above-mentioned liquid discharge head of the present invention, and drive signal supply means for supplying a drive signal for causing the liquid discharge head to discharge liquid. The liquid discharge apparatus of the present invention may also comprise the above-mentioned liquid discharge head of the present invention, and recording medium conveying means for conveying a recording medium for receiving the liquid discharged from the liquid discharge head. Further, the liquid discharge apparatus of the present invention is preferably so constructed as to execute recording by depositing the ink onto the recording medium.

DETAILED DESCRIPTION OF THE PREFERRED EMBODIMENTS

Now the present invention will be clarified in detail by embodiments thereof, with reference to the attached drawings.

At first the configuration of the liquid discharge head and the outline of the producing method will be explained with reference to FIGS. 1 to 6H.

Figure 1:
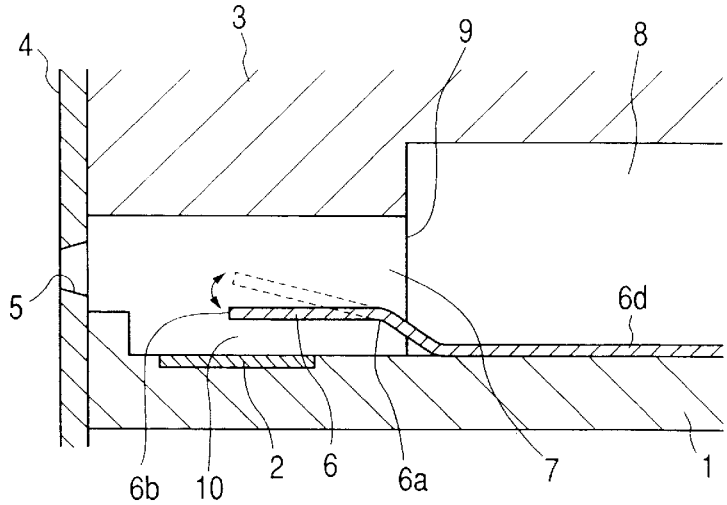
FIG. 1 is a cross-sectional view in a direction along the liquid path, showing the basic configuration of a liquid discharge head embodying the present invention.

FIG. 1 is a cross-sectional view, in a direction along the liquid path, showing the basic configuration of the liquid discharge head constituting an embodiment of the present invention. As shown in FIG. 1, the liquid discharge head of the present embodiment is provided with an element substrate 1 on which plural heat generating members 2 (only one being illustrated) are formed in parallel manner as the discharge energy generating elements for generating thermal energy for generating a bubble in the liquid, a ceiling plate 3 adhered onto the element substrate 1, and an orifice plate 4 adhered to the front end face of the element substrate I and the ceiling plate 3.

The element substrate 1 is formed by forming a silicon oxide film or a silicon nitride film for electrical insulation and heat accumulation on a substrate such as of silicon and patterning thereon an electrical resistance layer constituting the heat generating member 2 and wirings therefor. The wirings serve to apply a voltage to the electrical resistance layer to induce a current therein, thereby generating heat in the heat generating member 2. On the wirings and the electrical resistance layer, there is formed a protective film for protection from the ink, and an anticavitation film is formed thereon for protection from the cavitation resulting from the vanishing of the ink bubble.

The ceiling plate 3 serves to form plural liquid paths 7 respectively corresponding to the heat generating members 2 and a common liquid chamber 8 for supplying the liquid paths 7 with the liquid, and is integrally provided with liquid path lateral walls 9 extending from the ceiling to the gaps between the heat generating members 2. The ceiling plate 3 is composed of a silicon-containing material, and the liquid paths 7 and the common liquid chamber 8 are formed by pattern etching of a silicon substrate or by depositing silicon nitride or silicon oxide constituting the lateral walls 9 onto the silicon substrate by a known film forming method such as CVD and then etching the portions of the liquid paths 7.

In the orifice plate 4, there are formed plural discharge openings 5 respectively corresponding to the liquid paths 7 and communicating with the common liquid chamber 8 through the liquid paths 7. The orifice plate 4 is also composed of a silicon-based material, and is formed for example by scraping a silicon substrate, on which the discharge openings 5 are formed, into a thickness of 10 to 150 $\mu$m. The separate orifice plate 4 is, however, not an essential component in the present invention, and may be replaced by a ceiling plate 3 having the discharge openings, formed by retaining a wall of a thickness corresponding to that of the orifice plate 4 at the front end face of the ceiling plate 3 at the formation of the liquid paths 7 thereon and forming the discharge openings 5 in the thus retained wall portion.

In addition, the liquid discharge head is provided with a movable member 6 in the form of a beam supported at an end, so positioned as to be opposed to the heat generating member 2. The movable member 6 is composed of a thin film of a silicon-containing material such as silicon nitride or silicon oxide.

The movable member 6 is so provided as to have a fulcrum 6*a* at the upstream side in the direction of a main liquid flow generated by the liquid discharging operation from the common liquid chamber 8 through the movable member 6 toward the discharge opening 5 and to have a free end 6*b* at the downstream side with respect to the fulcrum 6*a*, and as to be in a position opposed to the heat generating member 2 with a predetermined distance therefrom and to have the free end 6*b* in the vicinity of the center of the heat generating member. The space between the heat generating member 2 and the movable member 6 constitutes a bubble generating area 10.

When the heat generating member 2 generates heat in the above-described configuration, heat is applied to the liquid in the bubble generating area 10 between the movable member 6 and the heat generating member 2, whereby a bubble is generated and grows on the heat generating member 2, based on the film boiling phenomenon. The pressure resulting from the growth of the bubble preferentially acts on the movable member 6, whereby the movable member 6 displaces so as to open widely toward the discharge opening 5 about the fulcrum 6a, as indicated by a broken line in FIG. 1. The displacement of the movable member 6 or the displaced state thereof guides the pressure based on bubble generation and the growth of the bubble itself toward the discharge opening 5, whereby the liquid is discharged therefrom.

Thus, by positioning the movable member 6 on the bubble generating area 10, with the fulcrum 6*a* at the upstream side (side of common liquid chamber 8) of the liquid flow in the liquid path 7 and with the free end 6*b* at the downstream side (side of discharge opening 5), the propagation of the bubble pressure is guided toward the downstream side whereby the bubble pressure directly and efficiently contributes to the liquid discharge. Also the growing direction itself of the bubble is guided toward the downstream side, like the direction of pressure propagation, whereby the bubble grows larger in the downstream side than in the upstream side. Such control of the growing direction itself of the bubble and the propagating direction of the bubble pressure by the movable member allow to improve the fundamental discharging characteristics of the discharge efficiency, discharge force or discharge speed.

On the other hand, when the bubble enters a vanishing stage, the bubble shrinks rapidly by the multiplying effect with the elastic force of the movable member 6, whereby it eventually returns to the solid-lined initial position shown in FIG. 1. In order to compensate for the volumic shrinkage of the bubble in the bubble generating area 10 and the volume of the discharged liquid, the liquid flows in from the common liquid chamber 8 to achieve liquid refilling into the liquid path 7, and such liquid refilling is achieved efficiently, reasonably and stably in cooperation with the returning operation of the movable member 6.

As explained in the foregoing, in such liquid discharge head of the present embodiment, the element substrate 1 is composed of a silicon substrate, while the ceiling plate 3, liquid path lateral walls 9, orifice plate 4 and movable member 6 are composed of silicon-based materials, so that silicon is contained in all these components. Consequently, there can be suppressed the stress generated from the difference in the linear expansion coefficients of these components. It is therefore made possible to improve the mechanical characteristics of the liquid discharge head, thereby stabilizing the discharge characteristics and realizing the liquid discharge head of high reliability.

Figure 2:
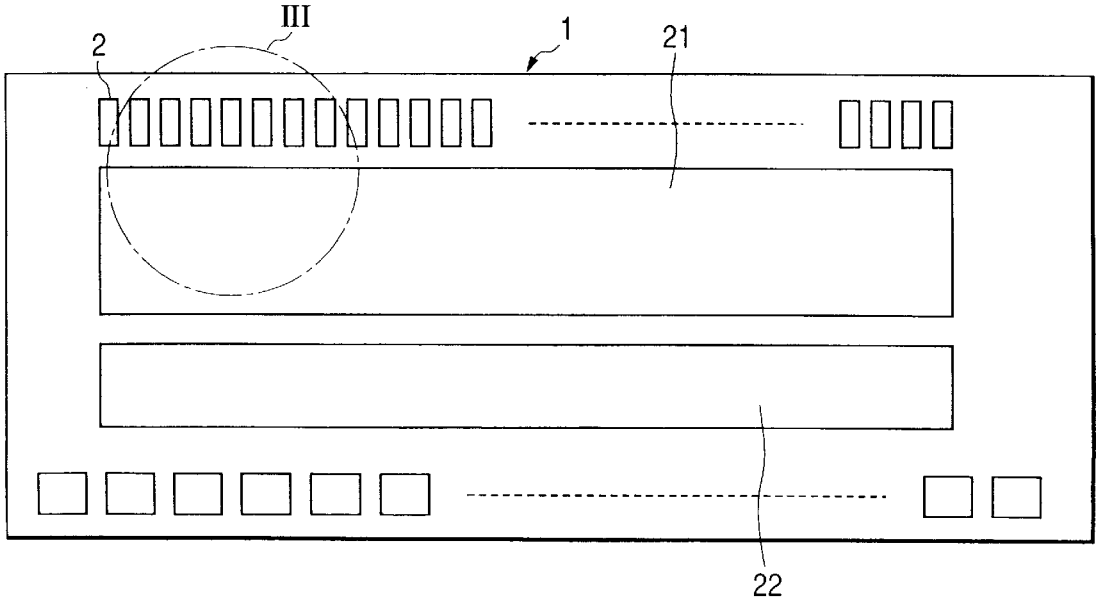
FIG. 2 is a plan view showing an element substrate shown in FIG. 1.

FIG. 2 is a plan view of the element substrate 1 shown in FIG. 1. On a face of the element substrate 1, at the side of the ceiling plate 3, plural heat generating members 2 are arranged in parallel along an edge of the element substrate 1 as shown in FIG. 2. On the above-mentioned face of the element substrate 1, the central portion constitutes a heater driver forming area 21, in which plural heater drivers 31 (not shown in FIG. 2) are arrayed in a direction same as the array direction of the plural heat generating members 2. Also in a portion of the heater driver forming area 21, opposite to the heat generating member 2, there is formed a shift register latch 22.

Figure 3:
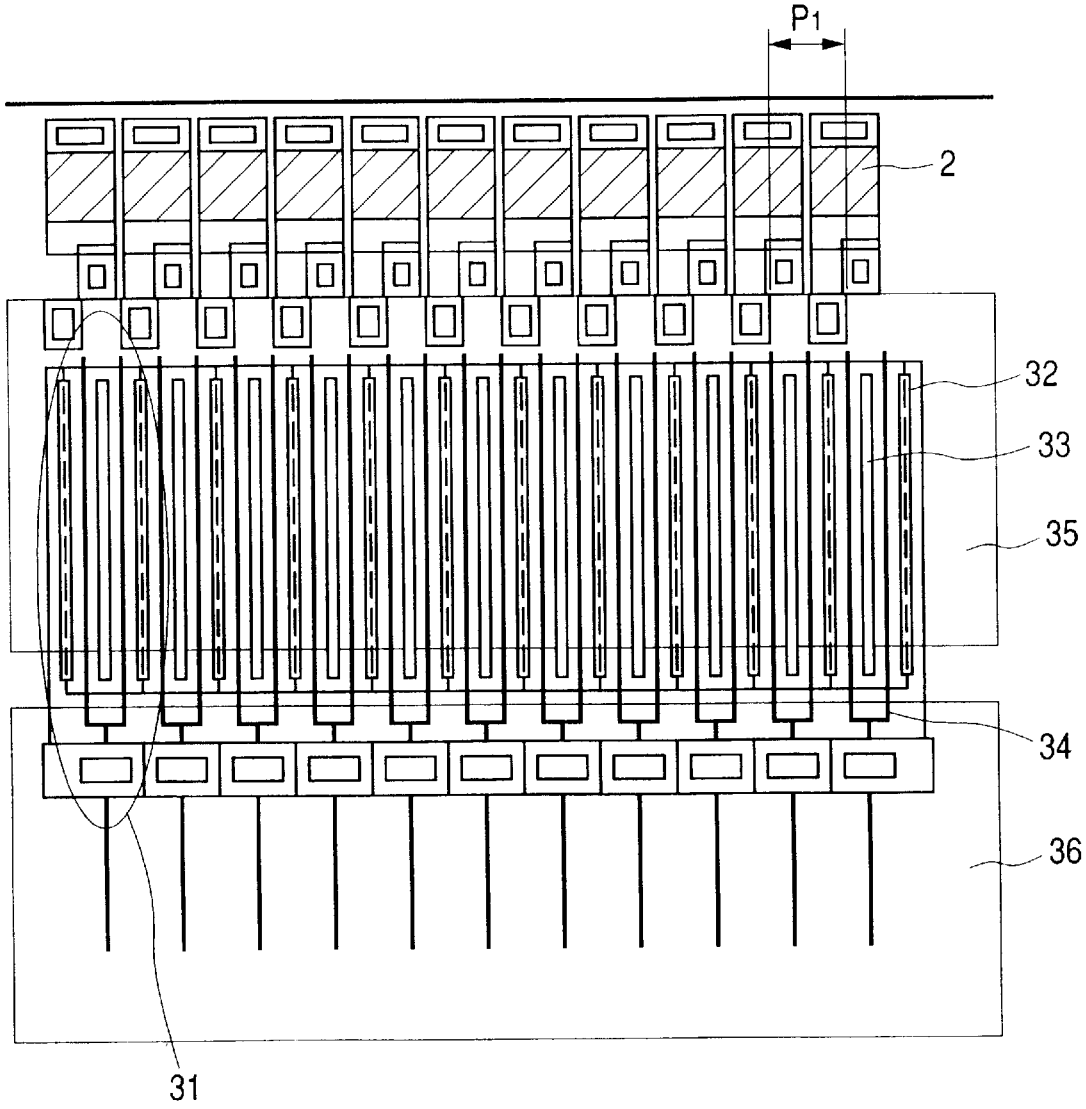
FIG. 3 is a magnified view of a portion III in FIG. 2.

FIG. 3 is a magnified view of a portion III in FIG. 2. The element substrate 1 of the present embodiment employs heaters arranged with a high density, providing a resolution of 600 dpi (dot per inch) or higher in the recorded image. In consideration of the arrangement of wirings on the element substrate 1, the heater drivers 31 for driving the heat generating members 2 are arranged in a linear array. In the heater driver forming area 21 shown in FIG. 2, the heater drivers 31 are formed in a direction parallel to that of the heat generating members 2 as shown in FIG. 3. The pitch P1 of the heater drivers 31 is same as the pitch of the heat generating members 2, and is selected in a range of 15 to 42 $\mu$m.

Each heater driver 31 is composed of a source 32 extending in a direction perpendicular to the direction of array of the heater drivers 31, a drain 33 and a gate 34 parallel to the source 32, and the drain 33 is electrically connected to the heat generating member 2. In the heater driver forming area 21, there are formed a heater driving power source 35 and a ground 36 composed of a metal layer.

The heater driver 31 is required to have a high breakdown voltage (about 10 to 50 V) and to be of a very narrow width in order to be arranged with a pitch of 15 to 42 $\mu$m as explained above. The heater driver 31 satisfying such requirements can be composed of a transistor of offset MOS type, LDMOS type or VDMOS type.

Figure 4:
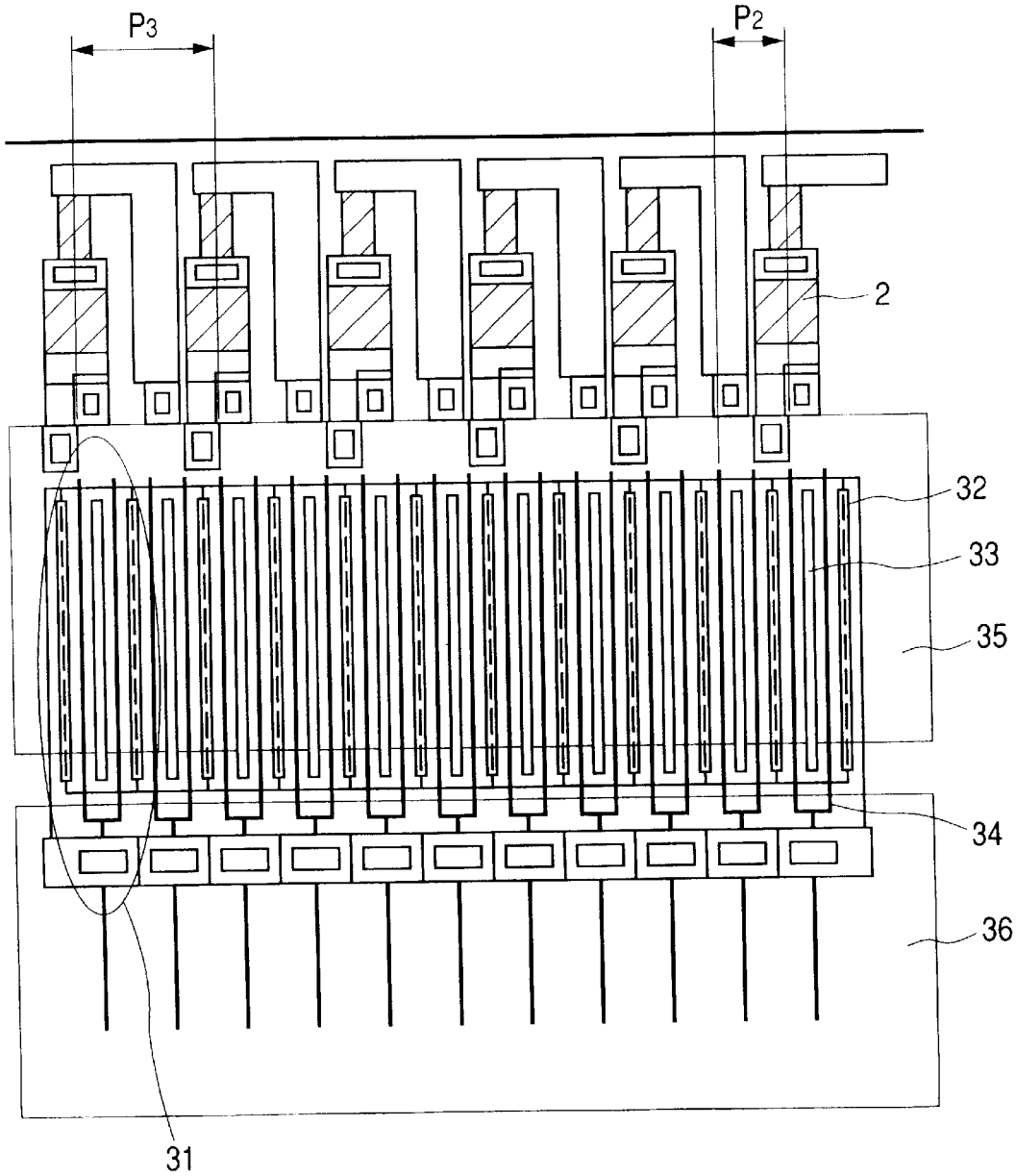
FIG. 4 is a magnified view showing a variation of the element substrate shown in FIG. 1.

FIG. 4 is a magnified view showing a variation of the element substrate 1 shown in FIG. 1. In contrast to the configuration shown in FIG. 3 in which the pitch of the heater drivers 31 is same as that of the heat generating members 2, in the configuration shown in FIG. 4, the pitch P3 of the heat generating members 2 is twice the pitch P2 of the heater drivers 31. With such element substrate 1, plural heat generating members 2 are positioned for each nozzle and are driven for a single nozzle thereby achieving tonal recording.

In the following there will be explained an example employing the element substrate 1 of the configuration shown in FIGS. 3 or 4, wherein the heat generating members 2 are so arranged as to attain a resolution of 1200 dpi on the recorded image. In such case, the voltage of the power source for driving the heat generating member 2 is preferably as high as possible, in consideration of fluctuation in the resistance of wirings, in the power source itself or in the heater drivers 31. In the present embodiment, the voltage of the power source is selected as 24 V. The pitch of the heat generating members 2 is about 21 $\mu$m, and the width thereof is selected as 14 $\mu$m including a margin. The length of the heat generating member 2 is selected as 60 $\mu$m, in order to secure the area thereof required for attaining the recording density of 1200 dpi. In order to drive the heat generating member 2 with an interval of several microseconds, the resistance of the heat generating member 2 has to be made high, and the sheet resistance thereof is required to be 50 Ω/□ or higher.

Therefore, the resistance of the heat generating member 2 for 1200 dpi is selected as 200 Ω or higher, by selecting TaSiN as the material therefor. The heater driver 31 is composed of a transistor of LDMOS type which can be formed relatively small in the width direction. An image of 1200 dpi can be recorded by driving the liquid discharge head of such configuration.

In the liquid discharge head with the heat generating members 2 arranged with a high density as explained above, the heater driver 31 can be composed of a transistor of offset MOS type, LDMOS type or VDMOS type, whereby the heater drivers can be arranged in a linear array of a high density on the element substrate 1 and the wirings can be arranged in an efficient layout on the element substrate 1. As a result, the element substrate 1 can be formed compact in the chip size. Also there can be realized the liquid discharge head with limited fluctuation in the voltage applied to the heat generating members, by the combination of the heat generating members 2 having a sheet resistance as high as 50 Ω/□ or higher and the heater driver 31 of the above-mentioned MOS structure capable of withstanding a voltage of 10 V or even higher.

In the following there will be explained the method for producing the liquid discharge head of the present embodiment. FIGS. 5A to 5J and 6A to 6H illustrate the producing method for the liquid discharge head explained with reference to FIG. 1. FIGS. 5A to 5E and 6A to 6D are cross-sectional views along a direction perpendicular to the extending direction of the liquid paths, and FIGS. 5F to 5J and 6E to 6H are corresponding cross-sectional views in the direction along the liquid paths. The liquid discharge head of the present embodiment is prepared through steps shown in FIGS. 5A to 5J and 6A to 6H.

Figure 5A:
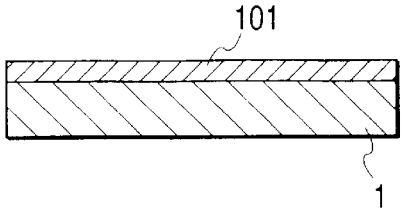
FIGS. 5A, 5B, 5C, 5D, 5E, 5F, 5G, 5H, 5I and 5J are views showing the method for producing the liquid discharge head shown in FIG. 1.
Figure 5B:
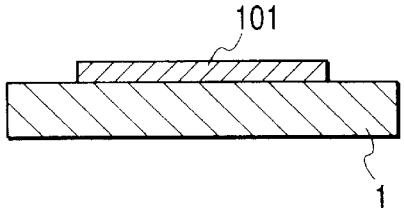
Figure 5C:
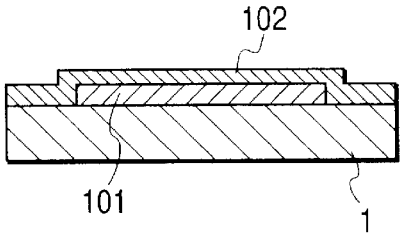
Figure 5D:
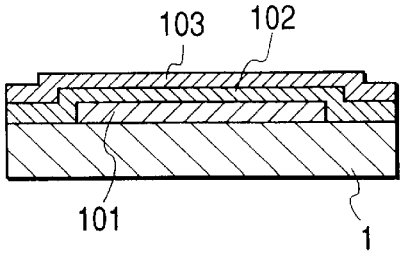
Figure 5E:
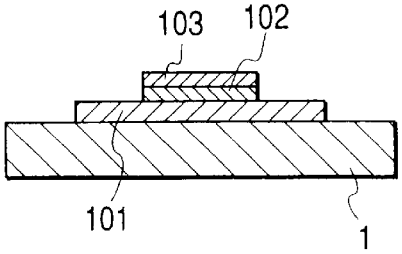
Figure 5F:
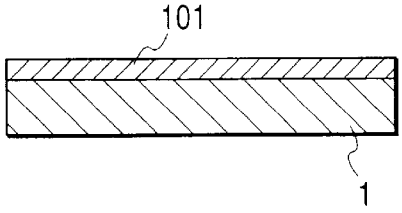
Figure 5G:
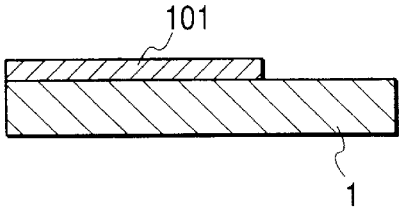

At first, as shown in FIGS. 5A and 5F, on the entire face of the element substrate 1 at the side of the heat generating members 2, a PSG (phosphosilicate glass) film 101 is formed by CVD at a temperature of 350° C. The thickness of the PSG film 101 corresponds to the gap between the movable member 6 and the heat generating member 2 shown in FIG. 1 and is selected as 1 to 20 $\mu$m. This gap is effective in enhancing the effect of the movable member 6 in the balance of the entire liquid path of the liquid discharge head. Then the PSG film 101 is patterned by applying a resist material on the PSG film 101 for example by spin coating, then executing exposure and development in the photolithographic process, and eliminating a portion of the resist where the movable member 6 is to be fixed.

Then the portion of the PSG film 101, not covered by the resist, is removed by wet etching employing buffered hydrofluoric acid. Then the resist remaining on the PSG film 101 is removed by oxygen plasma etching or by immersing the element substrate 1 in a resist remover. Thus, a part of the PSG film 101 remains on the surface of the element substrate 1 and constitutes a mold member corresponding to the space of the bubble generating area 10. Through these steps, a mold member corresponding to the space of the bubble generating area 10 is formed on the element substrate 1.

Figure 5H:
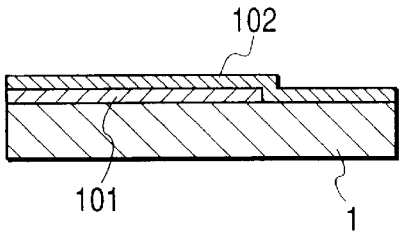

Then, as shown in FIGS. 5C and 5H, a SiN film 102 of a thickness of 1 to 10 $\mu$m is formed as a first material layer, on the surface of the element substrate 1 and the PSG film 101, by plasma CVD at 400° C., employing ammonia and silane gas. A part of the SiN film constitutes the movable member 6. $Si_3N_4$ is best for the composition of SiN film 102, but the proportion of N with respect to Si can be within a range of 1 to 1.5 in order to obtain the effect of the movable member 6. Such SiN film is commonly employed in the semiconductor process and has alkali resistance, chemical stability and ink resistance. The method for producing the SiN film 102 is not limited as long as the material thereof has a structure and a composition for obtaining the optimum physical properties for the movable member 6, as a part of this film constitutes the movable member 6. For example, the SiN film 102 can be formed, instead of by the plasma CVD, by normal pressure CVD, LPCVD, biased ECRCVD, microwave CVD, sputtering or coating. Also the SiN film may have a multi-layered structure with successive changes in the composition, in order to improve the physical properties such as stress, rigidity or Young's modulus, or chemical properties such as alkali resistance or acid resistance. It is also possible to realize a multi-layered structure by successive additions of an impurity or addition of add an impurity in a single-layered film.

Figure 5I:
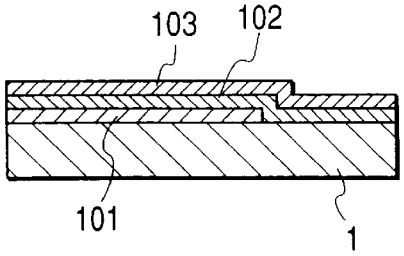

Then, as shown in FIGS. 5D and 5I, an anti-etching protective film 103 is formed on the SiN film 102. As the anti-etching protective film 103, an A1 film of a thickness of 2 $\mu$m is formed by sputtering. The anti-etching protective film 103 prevents damage to the SiN film 102 for constituting the movable member 6, in a next etching step for forming the liquid path lateral walls 9. In case the movable member 6 and the lateral walls 9 of the liquid path are formed with substantially similar materials, the movable member 6 is also etched at the etching for forming the lateral walls 9. Therefore, in order to prevent damage by etching on the movable member 6, the anti-etching protective film 103 is formed on a face of the SiN film 102 constituting the movable member 6, opposite to the element substrate 1.

Then, in order to form the SiN film 102 and the anti-etching protective film 103 into a predetermined shape, a resist material is coated on the anti-etching protective film 103 for example by spin coating and photolithographic patterning is executed.

Figure 5J:
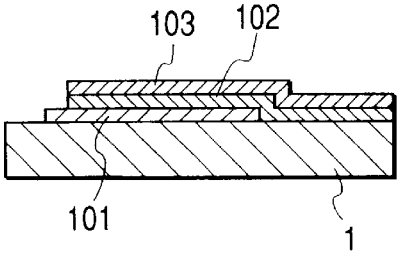

Then as shown in FIGS. 5E and 5J, the SiN film 102 and the anti-etching protective film 103 are etched into the shape of the movable member 6 by dry etching for example with $CF_4$ gas or by reactive ion etching. In this manner the movable member 6 is formed on the surface of the element substrate 1. In the foregoing description, the anti-etching protective film 103 and the SiN film 102 are patterned at the same time, but it is also possible to initially pattern the protective film 103 alone into the shape of the movable member 6 and then to pattern the SiN film 102 in a later step.

Figure 6A:
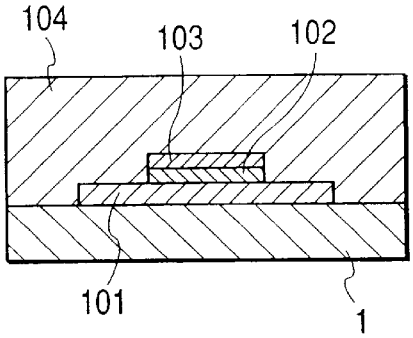
FIGS. 6A, 6B, 6C, 6D, 6E, 6F, 6G and 6H are views showing the method for producing the liquid discharge head shown in FIG. 1.
Figure 6B:
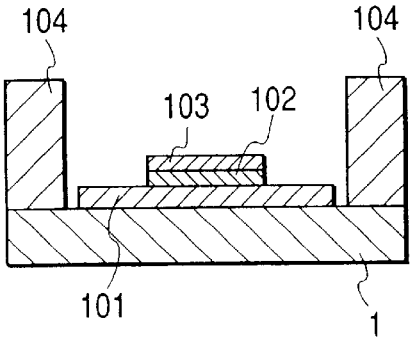
Figure 6C:
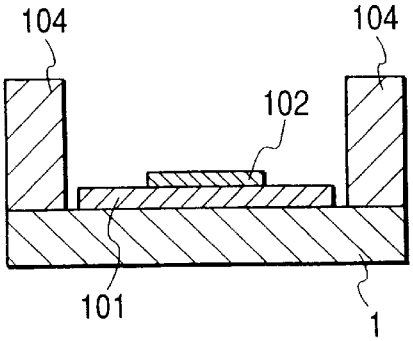
Figure 6D:
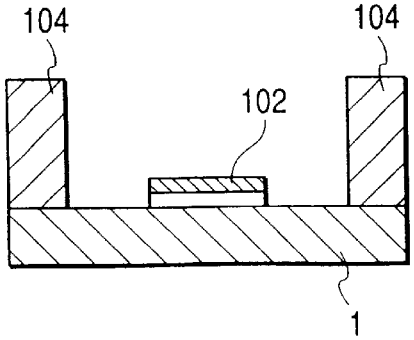
Figure 6E:
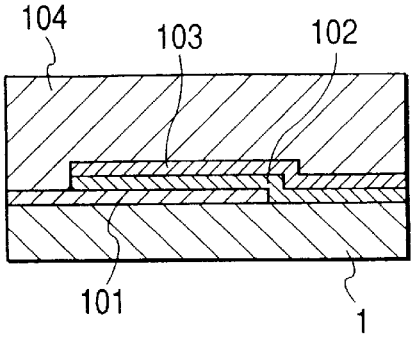

Then, as shown in FIGS. 6A and 6E, a SiN film 104 of a thickness of 20 to 40 $\mu$m is formed as a second material layer, on the anti-etching protective film 103, PSG film 101 and element substrate 1. Microwave CVD is employed in case prompt formation of the SiN film 104 is desired. The SiN film 104 eventually constitutes the lateral walls 9 of the liquid path. For the SiN film 104, there are not required the film properties ordinarily required in the semiconductor manufacturing process, such as the pinhole concentration or the film density, but the SiN film 104 is only required to satisfy the ink resistance and the mechanical strength as the lateral walls 9 of the liquid path. The pinhole concentration of the SiN film 104 may become somewhat higher by the fast film formation thereof.

Also, the material of the liquid path lateral walls 9 is not limited to SiN film but can be composed of any film with suitable mechanical strength and ink resistance such as a SiN film containing an impurity or a SiN film with modified composition. It can also be composed of a diamond film, a hydrogenated amorphous carbon film (diamond-like carbon film) or an inorganic film of alumina or zirconia family.

Figure 6F:
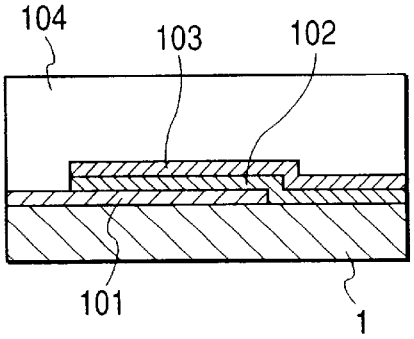

Then, in order to form the SiN film 104 into a predetermined shape, a resist material is coated on the SiN film 104 for example by spincoating and photolithographic patterning is executed. Then, as shown in FIGS. 6B and 6F, the SiN film 104 is formed into the shape of the liquid path lateral walls 9 by dry etching for example with $CF_4$ gas or by reactive ion etching. ICP (induction coupled plasma) etching is most suitable for high-speed etching of the thick SiN film 104. In this manner the lateral walls 9 of the liquid path are formed on the surface of the element substrate 1. After the etching of the SiN film 104, the resist remaining thereon is removed by plasma ashing with oxygen plasma or by immersing the element substrate 1 in a resist remover.

Figure 6G:
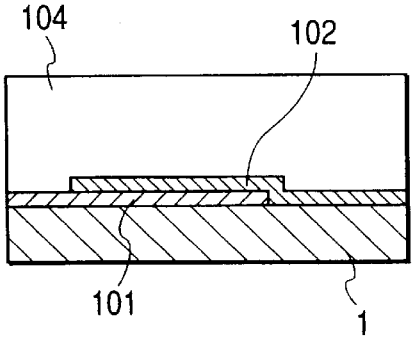

Then, as shown in FIGS. 6C and 6G, the anti-etching protective film 103 on the SiN film 102 is removed by wet etching or by dry etching. In addition to these methods, there may be employed any method capable of removing the anti-etching protective film 103 only. Also the anti-etching protective film 103 need not be removed if it does not detrimentally influence the characteristics of the movable member 6 and is composed of a film of high ink resistance such as a Ta film.

Figure 6H:
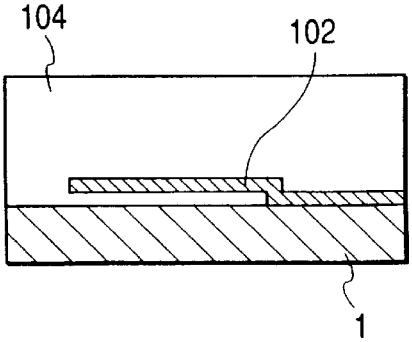

Then, as shown in FIGS. 6D and 6H, the PSG film 101 under the SiN film 102 is removed with buffered hydrofluoric acid whereby the liquid discharge head of the present embodiment is completed.

In the above-described method for producing the liquid discharge head, the movable member 6 and the lateral walls 9 of the liquid path are directly formed on the element substrate, so that, in comparison with the case of separately preparing and thereafter assembling these components, there can be dispensed with the assembling step and the manufacturing process can be simplified. Also, as the movable member need not be adhered with an adhesive material, the liquid inside the liquid path 7 is not contaminated by such adhesive material. Furthermore, it is possible to avoid damaging the surface of the element substrate 1 during assembling or dust generation during adhesion of the movable member 6. Furthermore, as the components are formed through semiconductor manufacturing steps such as photolithography or etching, the movable member 6 and the liquid path lateral walls 9 can be formed with a high precision and with a high density.

Also, as various wirings are formed by patterning on the element substrate 1, the surface thereof is not flat a in strict sense. Stated differently, the surface of the element substrate 1 has step differences according to the thicknesses of the formed wirings. Since the movable member 6 is formed, on the element substrate 1, by a semiconductor manufacturing process involving, for example, photolithographic technology and etching, the cross-sectional shape of the movable member 6 is influenced by the step differences on the surface of the element substrate 1.

Figure 7A:
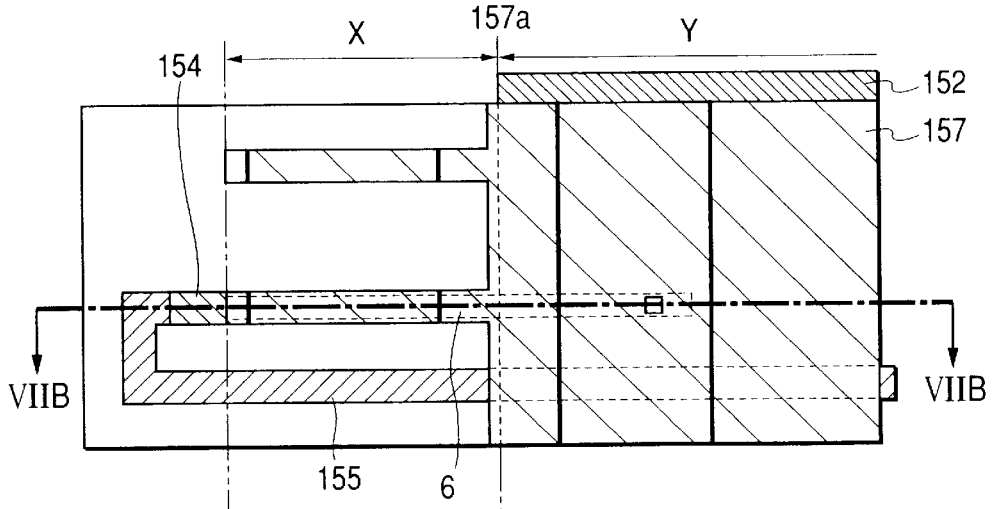
FIGS. 7A and 7B are respectively a schematic plan view and a cross-sectional view along a line VIIB—VIIB in FIG. 7A, showing the detailed structure of the element substrate and the movable member of the liquid discharge head.

In the following, such situation will be explained with reference to FIGS. 7A and 7B, which are respectively a schematic plan view and a cross-sectional view along a line VIIB—VIIB in FIG. 7A, showing the detailed structure of the element substrate and the movable member of the liquid discharge head.

Figure 7B:
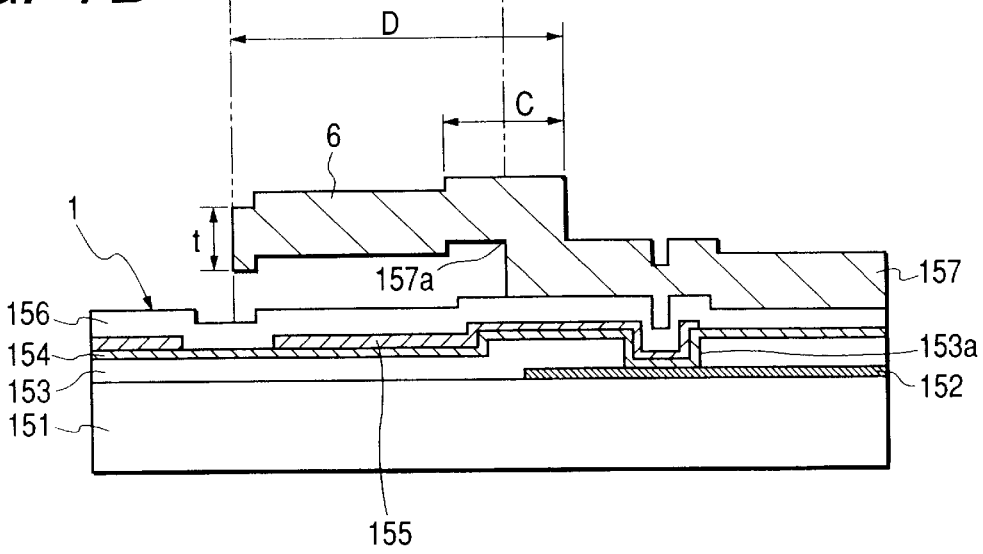

As shown in FIGS. 7A and 7B, on a silicon substrate 151 constituting a base, there is formed a first wiring layer 152 composed of A1 and constituting a common wiring, and an interlayer insulation layer 153 composed of silicon oxide is formed thereon so as to cover the entire silicon substrate 151. In a position of the interlayer insulation layer 153 corresponding to the first wiring layer 152, there is formed a through-hole 153*a* for connection with a second wiring layer (individual wiring) 155 to be explained later. On the interlayer insulation layer 153 there is formed a heat generating member layer (electric resistance layer) 154, and a second wiring layer 155 composed of A1 and constituting an individual wiring is formed on the heat generating member layer 154. The element substrate is completed by forming a protective film 156 on the second wiring layer 155. On the thus obtained element substrate 1, a movable member layer 157 consisting of silicon nitride is formed in a comb-tooth shape, matching the shape of the movable member 6.

A voltage application between the first wiring layer 153 and the second wiring layer 155 causes heat generation in the heat generating member layer 154, and an area thereof where the second wiring layer 155 is not formed substantially functions as the heat generating member.

In the above-described laminated structure, the first wiring layer 152 and the second wiring layer 155 in particular are not formed on the entire surface of the silicon substrate 151 but formed with a predetermined pattern, and the through-hole 153*a* is also formed therein, so that step differences are formed on the surface of the protective film 156 (surface of element substrate 1). As a result, the movable member layer 157 formed on the element substrate 1 assumes a form obtained by transferring the surfacial form of the element substrate 1, containing unnecessary step differences corresponding to those on the element substrate 1 in addition to the step difference at the boundary between the fixing portion and the movable portion. As an example, in case the first wiring layer 152 and the second wiring layer 155 are formed with a thickness of 0.5 $\mu$m and the interlayer insulation layer 153 is formed with a thickness of 1.2 $\mu$m and with the through-hole 153*a* therein, the surface of the protective film 156 eventually shows an unnecessary step difference of 1.2 $\mu$m at maximum.

As the movable member layer 157 serves to constitute the movable member 6, the durability of the movable portion and the fulcrum portion is particularly important in consideration of the mobility of the movable member 6. The above-described step difference is deeply related to the durability of the movable member 6, and may significantly deteriorate the durability thereof depending on the position and height of the step difference.

The investigations made by the present inventors have clarified that the absence of step difference is important in the vicinity of the fulcrum 157*a* which is the boundary between the fixing portion Y and the movable portion X of the movable member 6. The absence of the step difference in the vicinity of the fulcrum means that the step difference is absent at least directly under an area C where the height of the outermost surface of the movable member varies in relation to the gap thereof.

As explained in the foregoing, the largest factor leading to the formation of step difference is the through-hole for interlayer electrical connection. Consequently, the durability of the movable member 6 can be improved by providing the through-hole 153*a* in a position different from the boundary between the movable portion and the fixing portion of the movable member 6 as shown in FIGS. 7A and 7B. Stated differently, the durability of the movable member 6 is significantly deteriorated if a step difference is present at the boundary between the movable portion and the fixing portion of the movable member 6 on the surface of the element substrate 1. This is presumably because a large force is applied to the fulcrum 157*a* at the displacement of the movable portion of the movable member 6 by the power of bubble generation in the ink, and, if a step difference caused by the step difference on the element substrate 1 is present in the vicinity of the fulcrum 157*a* of the movable member 6, the stress is concentrated in such area to exhibit a larger force in comparison with the case where the step difference is present in another position, whereby the destruction of the movable member 6 starts from such area.

By positioning the through-hole intentionally in the fixing portion of the movable member, it is also possible to improve the adhesion of the fixing portion and to improve the reliability of the movable member. Such configuration is further preferable because the stress applied to the fixing portion covering the through-hole can be dispersed by forming the fixing portions of plural movable members in common (in a continuous form)as shown in FIGS. 7A and 7B.

Also the step differences formed on the surface of the element substrate 1 are not limited to that induced by the through-hole 153*a* but are also generated in positions corresponding to the end portion of the pattern in the lower layer. Such step differences are not so large as those caused by the through-hole 153*a*, but may influence, depending on the position and height of the step differences, the durability of the movable member 6.

Also, as the entire movable portion of the movable member 6 displaces significantly by the power of the bubble generated in the ink, the step difference formed in the movable portion affects, though slightly, the durability of the movable member 6 even if the step difference is absent in the above-mentioned area C on the element substrate. This is because the shape and film quality of the movable member are varied by the above-mentioned step difference in case the movable member is prepared on the substrate by the photolithographic process (and film forming process). Also, in the displacement of the movable member 6, a slight deformation is induced in the movable member 6 itself, and, if the movable portion thereof has a step difference induced by the step difference on the surface of the element substrate 1, there may be induced a stress concentration, though it is much smaller than that in the vicinity of the fulcrum 153*a*. Therefore, it is preferred that the step difference is absent on the surface of the element substrate 1 in an area D which is defined by expanding the above-mentioned area C toward the movable portion to the free end of the movable member 6.

For example, in case the first and second wiring layers 152, 155 and the interlayer insulation layer 153 are formed with the above-mentioned thicknesses and the thickness t of the movable material layer 157 is selected as 5 $\mu$m, the step difference formed on the surface of the element substrate 1 corresponding to the through-hole 153*a* becomes 1.2 $\mu$m. However, the durability of the movable member 6 is scarcely deteriorated if such step difference is positioned outside the above-mentioned area D. Positioning of the step difference outside the above-mentioned area D not only prevents the stress concentration mentioned above but also stabilizes the shape and film quality of the movable member, thereby providing a liquid discharge head and a substrate therefor, provided with a highly reliable movable member.

The step difference formed by the wiring pattern other than the through-hole 153*a* has also been investigated for the influence on the durability, but it has been found that the durability is scarcely affected if the step difference is positioned as explained above.

As explained in the foregoing, the absence of the step difference induced by the through-hole, etc., in the area C or D on the surface of the element substrate 1 relaxes the stress concentration in the vicinity of the fulcrum 157*a* or in the entire movable portion of the movable member 6 at the displacement thereof, whereby the durability of the movable member can be improved. As a result, the movable member can maintain the desired function over a prolonged period, whereby the discharge characteristics can be stabilized and a liquid discharge head with improved reliability can be obtained.

Figure 8A:
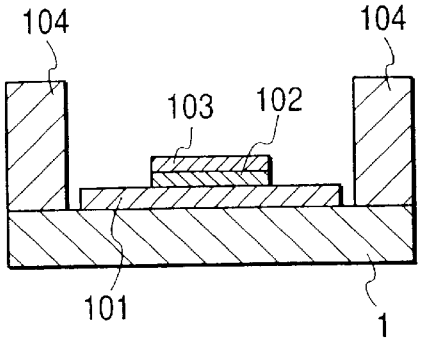
FIGS. 8A, 8B, 8C, 8D, 8E, 8F, 8G and 8H are views showing a variation of the method for producing the liquid discharge head explained in relation to FIGS. 5A to 5J and 6A to 6H.
Figure 8B:
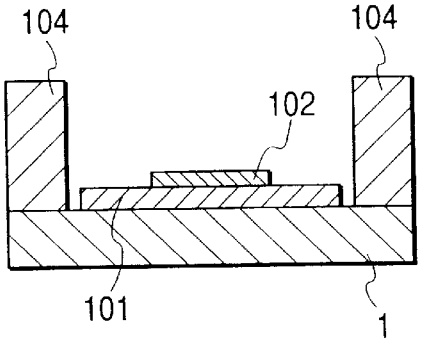

FIGS. 8A to BH illustrate a variation of the producing method for the liquid discharge head explained with reference to FIGS. 5A to 5J and 6A to 6H. This variation allows to prepare the liquid path walls 9 and the orifice plate 4 at the same time in the producing method for the liquid discharge head shown in FIGS. 5A to 5J and 6A to 6H. In the following there will be explained, with reference to FIGS. 6E to 6H, 7A, 7B and 8A to 8H, the producing method for the liquid discharge head in which the liquid path walls 9 and the orifice plate 4 are simultaneously formed. FIGS. 8A and 8B are cross-sectional views in a direction perpendicular to the extending direction of the liquid path, while FIGS. 8C and 8D are elevation views, and FIGS. 8E to 8H are cross-sectional views in a direction along the liquid path.

Figure 8C:
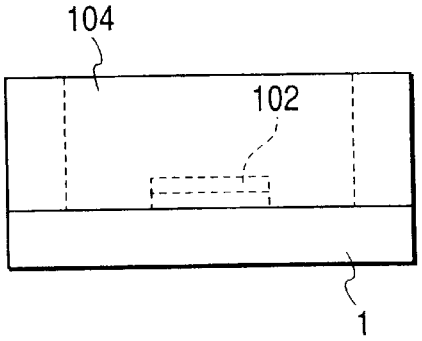
Figure 8D:
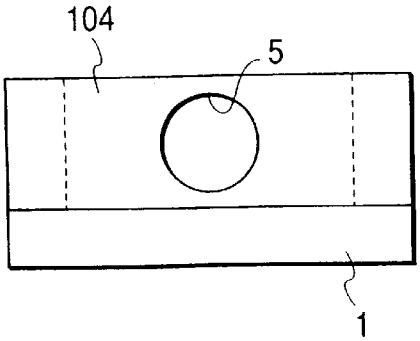
Figure 8E:
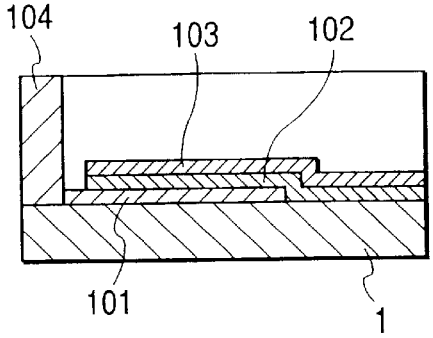

After the formation of the SiN film 104 as shown in FIGS. 6A and 6E, the SiN film 104 is subjected to photolithographic patterning and etching so as to leave portions thereof corresponding to the liquid path walls 9 and the orifice plate 4, as shown in FIGS. 8A and 8E. In this manner the orifice plate 4 and the liquid path walls 9 of a thickness of 2 to 30 μm are simultaneously formed on the surface of the element substrate 1.

Figure 8F:
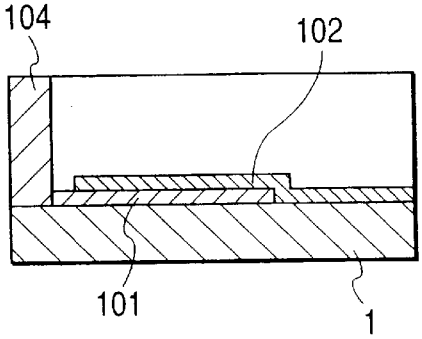

Then, as shown in FIGS. 8B and 8F, the anti-etching protective film 103 on the SiN film 102 is removed by wet etching or dry etching.

Figure 8G:
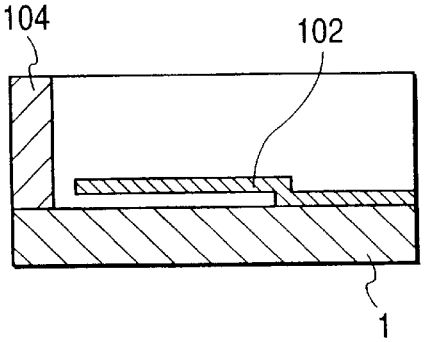

Then, as shown in FIGS. 8C and 8G, the PSG film 101 under the SiN film 102 is removed with buffered hydrofluoric acid.

Figure 8H:
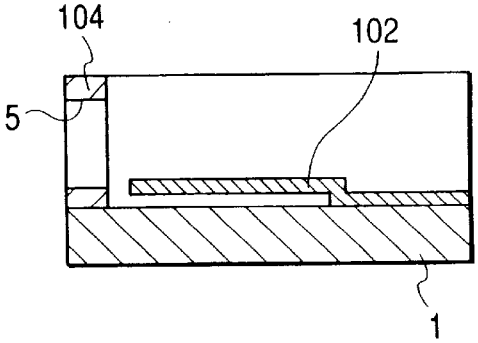

Then, as shown in FIGS. 8D and 8H, the orifice plate 4 is subjected to ablation by irradiation with an excimer laser, thereby forming the discharge opening 5 in the orifice plate 4. In this operation, the molecular bonding of the SiN film 102 is directly cleaved with a KrF excimer laser having a photon energy of 115 kcal/mol exceeding the dissociation energy of 105 kcal/mol of the SiN film 102. The work with the excimer laser, being a non-thermal work, can achieve a high precision without thermal deformation or carbonization around the worked part.

Also in the present method, the patterns of the wirings, etc., and the position of the through-hole to be formed on the element substrate 1 are so determined that the step difference of a height exceeding ⅕ of the thickness of the SiN film 102 is not generated, on the surface of the element substrate 1, in the aforementioned area C, preferably in the area D, defined with respect to the fulcrum of the movable portion of the SiN film 102 (movable member 6), and that the average inclining angle of the entire successive step differences does not exceed 20°.

Figure 9:
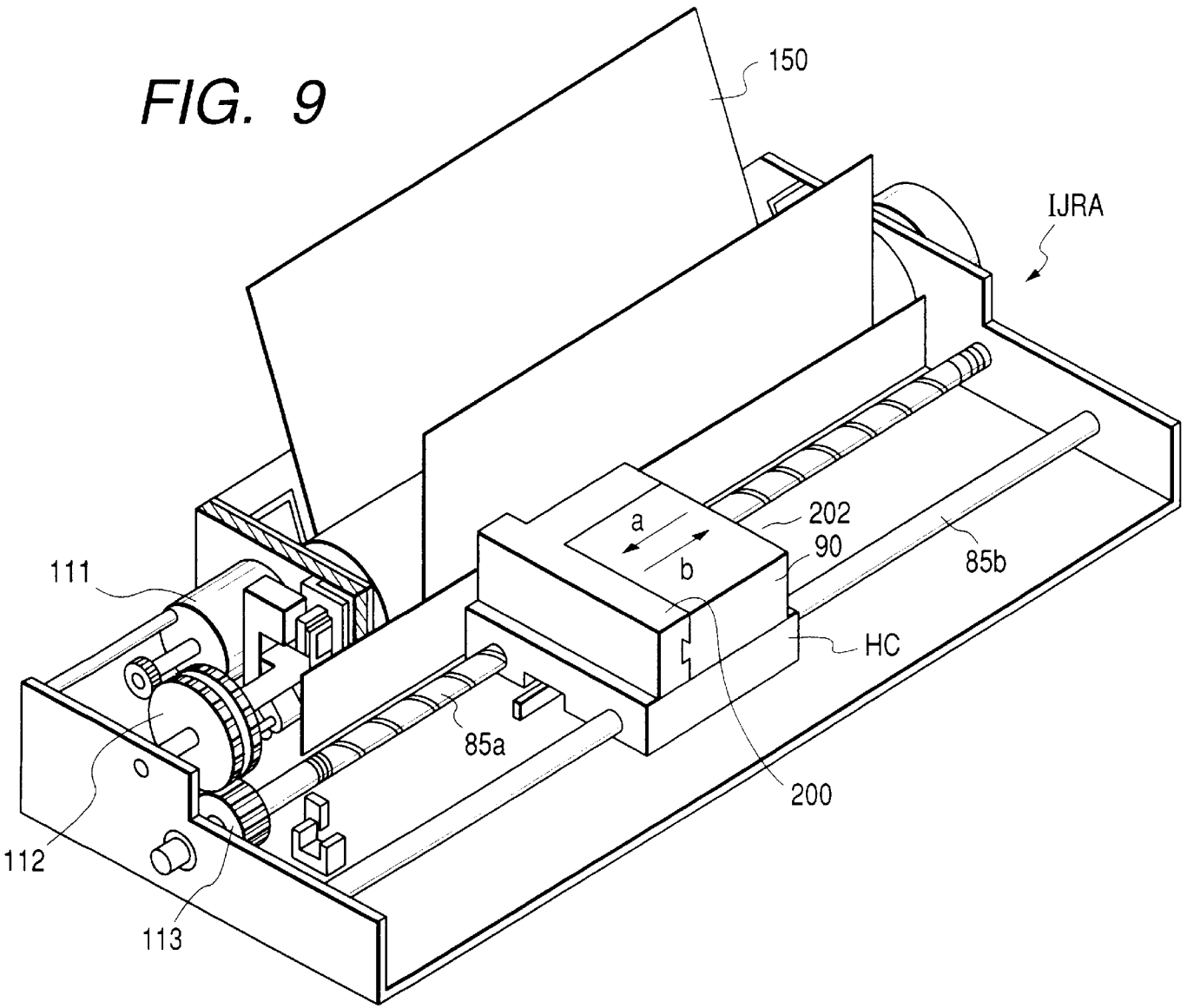
FIG. 9 is a perspective view showing a liquid discharge apparatus in which the liquid discharge head shown in FIG. 1 is mounted.

FIG. 9 is a perspective view of a liquid discharging apparatus in which the above-described liquid discharge head is mounted. In the present embodiment, there will be explained in particular an ink jet recording apparatus IJRA employing ink as the discharge liquid. As shown in FIG. 9, a carriage HC provided in the apparatus IJRA supports a head cartridge 202 in which a liquid container 90 containing ink and a liquid discharge head 200 are detachably mounted. The recording apparatus IJRA is also provided with recording medium conveying means, and the carriage HC reciprocates in the transversal direction (indicated by arrows a, b) of the recording medium 150 such as a recording sheet conveyed by the recording medium conveying means. When a drive signal is supplied from an unrepresented drive signal source to the liquid discharge head 200 on the carriage HC in the recording apparatus IJRA, the liquid discharge head 200 discharges ink toward the recording medium 150 in response to such drive signal.

The recording apparatus IJRA is further provided with a motor 111, gears 112, 113 and carriage shafts 85*a*, 85*b* for transmitting the power of the motor 111 to the carriage HC, thereby driving the recording medium conveying means and the carriage HC. Satisfactory recorded images can be obtained by discharging liquid to various recording media by the recording apparatus IJRA.

Figure 10:
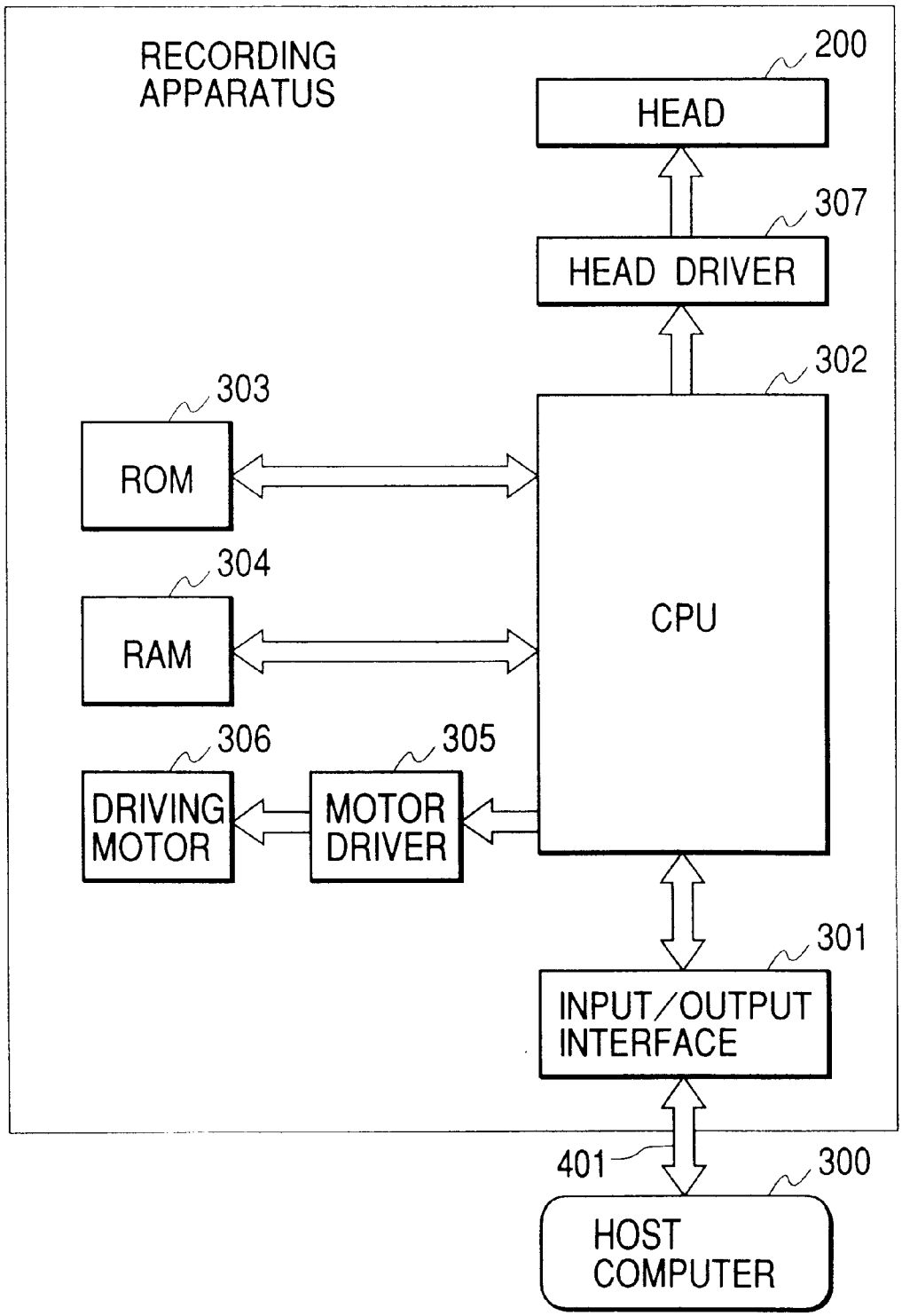
FIG. 10 is a block diagram of the entire apparatus for operating the ink discharge recording apparatus employing the liquid discharge head shown in FIG. 1.

FIG. 10 is a block diagram of the entire apparatus for driving the ink jet recording apparatus employing the liquid discharge head of the present invention.

As shown in FIG. 10, the recording apparatus receives the print information from a host computer 300, as a control signal 401. The print information is temporarily stored in an input/output interface 301 in the recording apparatus, and also converted into data processable in the recording apparatus and entered into a CPU 302 serving also as drive signal supply means. The CPU 302 processes the data entered thereto, utilizing periphery units such as a RAM 304 and based on a control program stored in a ROM 303, thereby converting the data into print data (image data).

Also the CPU 302 prepares data for driving a motor 306 for moving the recording sheet and the liquid discharge head 200 in synchronization with the image data, in order to record the image data at an appropriate position on the recording sheet. Simultaneously with the transmission of the image data through the head driver 307 to the liquid discharge head 200, the motor driving data is transmitted to the motor 306 through the motor driver 305. Thus the liquid discharge head 200 and the motor 306 are respectively driven at the controlled timing to form an image.

The recording medium applicable to the above-described recording apparatus and subjected to deposition of liquid such as ink can be various papers, an OHP sheet, plastic materials employed in compact disks or decoration plates, cloth, a metal plate such as of aluminum or copper, cow or pig leather, artificial leather, wood or plywood, bamboo, plastics such as a tile, a three-dimensionally structured material such as sponge, etc.

Also the above-described recording apparatus includes a printer for recording on various papers or OHP sheet; a plastics recording apparatus for recording on plastics such as a compact disk; a metal recording apparatus for recording on metal; a leather recording apparatus for recording on leather; a wood recording apparatus for recording on wood; a ceramic recording apparatus for recording on ceramics; a recording apparatus for recording on a three-dimensionally structure material such as sponge; and a dyeing apparatus for recording on cloth.

The discharge liquid to be employed in such liquid discharge apparatus can be designed according to respective recording medium and recording conditions.

What is claimed is:

1. A substrate for use in a liquid discharge head for discharging liquid by applying thermal energy thereto, said substrate comprising:

a heat generating member for applying the thermal energy to the liquid;

a movable member so positioned as to be opposed to said heat generating member and to be fixed at an upstream side in a flowing direction of the liquid and to have a free end at a downstream end; and two wiring layers for applying a voltage to said heat generating member, said two wiring layers being provided in a superposed manner with an interlayer insulation layer therebetween and being mutually connected electrically via a through-hole, wherein said through-hole is provided at a position different from a boundary between a fixing portion and a movable portion of said movable member.

2. A substrate according to claim 1, wherein said through-hole is provided in the fixing portion of said movable member.

3. A substrate for use in a liquid discharge head for discharging liquid by applying thermal energy thereto, said substrate comprising:

plural heat generating members for applying the thermal energy to the liquid;

plural movable members so formed by photolithographic technology as to be opposed to said heat generating members and to be fixed at an upstream side in a flowing direction of the liquid and to have free movable ends at a downstream end; and two wiring layers for applying a voltage to said plural heat generating members, said wiring layers being provided in a superposed manner with an interlayer insulation layer therebetween and being mutually connected electrically via plural through-holes, wherein said plural through-holes are provided at positions different from a boundary between fixing portions and movable portions of said movable members.

4. A substrate according to claim 3, wherein the fixing portions of said plural movable members are formed in common on the substrate, and said through-holes are positioned in said fixing portions.

5. A substrate according to claim 1, wherein a step difference is formed by said through-hole provided in said interlayer insulation layer for connecting said wiring layers.

6. A liquid discharge head provided with an element substrate surfacially bearing a heat generating member for applying thermal energy to a liquid, a ceiling plate member bearing a discharge opening for discharging the liquid and a groove communicating with said discharge opening, and constituting a liquid path upon being adhered to said element substrate, and a movable member so formed by photolithographic technology as to be opposed to said heat generating member in said liquid path and to be fixed to said element substrate at the upstream side in the flowing direction of the liquid and to have a free end at the downstream end, wherein said element substrate comprises said substrate according to any one of claims 1 to 5.

7. A liquid discharge head according to claim 6, wherein each movable member is composed of silicon nitride.

8. A liquid discharge apparatus comprising:

a liquid discharge head according to claim 6; and drive signal supply means for supplying a drive signal for causing liquid discharge from said liquid discharge head.

9. A liquid discharge apparatus comprising:

a liquid discharge head according to claim 6; and recording medium conveying means for conveying a recording medium for receiving the liquid discharged from said liquid discharge head.

10. A liquid discharge apparatus according to claim 8, adapted to discharge ink from said liquid discharge head and deposit the ink onto a recording medium, thereby achieving recording.

11. A liquid discharge apparatus according to claim 9, adapted to discharge ink from said liquid discharge head and deposit the ink onto the recording medium, thereby achieving recording.

* * * * *